United States Patent [19]

Varga

[11] Patent Number: 4,783,980

[45] Date of Patent: Nov. 15, 1988

[54] APPARATUS FOR MAKING HELICALLY WOUND INTERLOCKED FLEXIBLE PIPE

[75] Inventor: Joseph Varga, Toronto, Canada

[73] Assignee: Ceeco Machinery Manufacturing Limited, Concord, Canada

[21] Appl. No.: 109,959

[22] Filed: Oct. 19, 1987

[51] Int. Cl.[4] ..... B21C 37/12

[52] U.S. Cl. ..... 72/49; 72/66

[58] Field of Search ..... 72/49, 50, 66, 135, 72/137, 142, 145, 368; 228/17, 17.7, 145, 146

[56] References Cited

U.S. PATENT DOCUMENTS

| | | | |
|---|---|---|---|
| 1,004,644 | 10/1911 | Gilson | 72/49 X |
| 1,703,250 | 2/1929 | Sleeper | 72/66 |
| 1,703,251 | 2/1929 | Sleeper | 72/66 |
| 2,693,779 | 11/1954 | Padgett | 72/50 |
| 4,597,276 | 7/1986 | Legallais et al. | 72/49 |
| 4,724,596 | 2/1988 | Pavlyak | 72/49 X |

FOREIGN PATENT DOCUMENTS

| | | | |
|---|---|---|---|
| 0199557 | 10/1986 | European Pat. Off. | 72/49 |
| 218149 | 1/1910 | Fed. Rep. of Germany | 72/50 |
| 903565 | 2/1954 | Fed. Rep. of Germany | 72/50 |
| 985067 | 7/1951 | France | 72/50 |
| 110576 | 11/1917 | United Kingdom . | |

*Primary Examiner*—E. Michael Combs
*Attorney, Agent, or Firm*—Lilling & Greenspan

[57] ABSTRACT

An apparatus for making helically wound interlocked flexible pipe includes a rotating head mounted for rotation about a main shaft. Two supply spools of strip material are mounted on the rear side of the rotating head, a take off guide beam assembly being used to take off flat strip material from one of the spools, and guiding it to the rotating head. The rotating head is mounted on the main shaft for rotation therewith and supports a tool head assembly including a roller forming mill for forming the strip material. The strip is guided from a point behind the rotating head to a point in front of or downstream from the rotating head along the shaft. A face plate assembly, which supports the pressure rollers for closing and interlocking the successively adjacent turns of the formed strip, is axially spaced from the tool head assembly. A constant supply or reservoir of formed strip material, in the form of a loop in a substantially circular path, is provided to insure proper supply of formed strip material on demand to the pressure rollers. A sensor is used to monitor the instaneously contractions and expansions of the supply loop from its nominal size, such variations being utilized to modify and adjust the instaneous speed of rotation of the forming rollers. A rewinding system is used to rewind flat strip material on the other non-feeding supply spool. The apparatus assures simple and convenient start up of production of flexible pipe, and efficient operation without buckling or damage to the strip material.

24 Claims, 5 Drawing Sheets

APPARATUS FOR MAKING HELICALLY WOUND INTERLOCKED FLEXIBLE PIPE

BACKGROUND OF THE INVENTION

1. Field of the Invention

The present invention generally relates to metal forming machinery and more specifically, to an apparatus for making a continuous helically wound flexible pipe with an interlocked metal strip.

2. Description of the Prior Art

Flexible pipes made by shaping a metal strip and interlocking it on a mandrel have been made for many years and are used in a variety of applications including the use of such flexible structures as support members for the manufacture of flexible tubular pipes and conduits having high mechanical strength characteristics. These products, with high resistance to internal and external pressures, have been increasingly used for the transportion of fluids in situations where rigid steel pipes cannot be used or are economically too expensive.

Interlocked flexible pipes in short lengths are also used in a variety of applications like automotive exhaust connections, armouring of electrical cables, conduits, etc.

Equipment for manufacturing spiral pipes or helically interlocked tubing, have been known and used at least as early as 1876. Such equipment falls into one of two general categories: stationary or rotating machines.

Stationary machines normally include a supply reel, forming rollers, a mandrel and pressure rollers to wind the preformed strip over the mandrel. In this solution the machine is stationary while the pipe that is being made rotates about its longitudinal axis. The mandrel can be stationary or rotating in the direction of the moving strip.

The prior art shows examples of all possible solutions from fixed mandrel to mandrel overdriven in relation to the product to be formed. This prior art is clearly shown in U.S. Pat. Nos. 183,328, 2,162,355, 3,515,038 and 2,693,779.

It is clear that with stationary machines there is a limitation to the length that can be produced because of the necessity to rotate the product limits the length that can be economically made with this type of equipment. Long lengths can only be made if a rotatable takeup system is added and such equipment is very expensive when one thinks that a takeup reel for this product is tens of feet in diameter.

Furthermore, the rotation of the takeup equipment must be synchronized with the rotating product and in view of the large masses involved, the speed of rotation of the reel and therefore the productivity of such a system is very low.

In order to overcome such difficulties, rotating machines, such as the ones known from British Pat. No. 110,576, U.S. Pat. Nos. 1,703,250, 1,703,251 and 4,597,276 and French Patent No. 985,067 were developed. These apparatuses normally include a circular plate which turns around a horizontal axis coincident with the longitudinal axis of the tubular structure to be formed. The plate, frame or other rotating member turn around the axis of the mandrel on the surface of which the formed strip is wound. The prior art teaches that the mandrel can be stationary or rotating in order to facilitate the extraction of the pipe from the mandrel as shown in U.S. Pat. No. 1,004,644, U.K. Pat. No. 691,715 and French Patent No. 985,067.

The known rotating apparatuses include, on the same side of the plate where the product is formed, a support for a supply reel of flat strip, an assembly of driven shaping rollers to drive the strip and to give it the required shaped cross-section, guiding means for the strip between the supply reel and the assembly of forming rollers, a tubular mandrel mounted coaxially with the plate, and a forming and extraction mechanism for the winding of the strip onto the mandrel and the longitudinal removal of the pipe formed, downstream of the turning plate, to withdraw the structure formed toward a receiving reel. In addition to the fact that it is not possible with the prior art apparatuses to form an interlocked wound tubular pipe in long lengths without stopping the machine to change the supply reel, significant disadvantages of the prior art apparatuses also arise from the impossibility of controlling the speed of interlocking on the mandrel and the feeding speed of the forming rollers. As a matter of fact, in the prior art this problem is mentioned many times, but no final solution has yet been found.

SUMMARY OF THE INVENTION

The present invention provides an apparatus which allows the manufacture of tubular interlocked structures and which avoids the disadvantages mentioned above, while at the same time providing higher production rates. The apparatus according to the invention is characterized by the fact that the forming rollers are mounted in a tangential position in relation to the pipe to be formed and that a control loop is provided between the exit of the forming rollers and the mandrel around which the shaped strip is wound and interlocked. A dancer, positioned in the control loop, regulates the speed of the forming rollers, thus maintaining the control loop in the desired configuration.

It is important to note that this is where most of the buckling of the formed strips occur since it is very difficult in the prior art to maintain the formed strip under tension in view of the fact that in practice it is not possible to determine exactly the rate at which the pipe is wound on the mandrel. Stated otherwise, it is almost impossible to synchronize the instantaneous rate of pipe formation and the instantaneous rate of formation of the flat strip.

Besides providing a needed storage of formed strip, the control loop also advantageously bends the formed strip in the same direction of the pipe winding, thus avoiding the abrupt change from a straight strip to a bent strip which is characteristic of all prior art approaches.

By advantageously shifting the plane of the forming rollers from the plane on which the pipe is wound on the mandrel, it is also possible to shape the loop in a helical configuration, approximating the helical angle that the strip will assume in the flexible pipe.

According to the invention, decoupling or avoiding direct coupling between the strip forming station and the pipe forming station completely eliminates the likelihood of buckling and also advantageously pre-shapes or bends the formed strip to aid or facilitate its shaping into the configuration that it will take in the finished pipe.

It is also an advantage of the present invention that it maintains a perfectly balanced head during operation since the flat strip is stored in a "dummy stool" which rotates concentrically with the head thus maintaining a perfectly balanced rotating mass irrespective of the amount of strip that remains on the spool.

The machine is also advantageously provided with two dummy spools which alternately feed the forming head. The two dummy spools are mounted coaxially on the same shaft and can be turned freely independently from the forming head.

The productivity is further increased since the rotating mass is always in balance and it is possible to achieve speeds far in excess of those normally achievable with prior art equipment.

The broader aspects of the apparatus for making helically wound interlocked flexible pipe in accordance with the present invention comprises a rotating head mounted for rotation about an axis which substantially coincides with a longitudinal axis of the interlocked flexible pipe to be formed. Said rotating head defines the front side facing the direction where the product is formed and an opposing rear side. Strip supply means is provided for supplying strip material to said front side of said rotating head. A driven forming means is provided for forming said strip material into a formed strip having a predetermined intermediate cross-sectional configuration suitable for interlocking in a closing step. A tubular mandrel, coaxial with said axis, projects beyond said front side of said rotating head. Closing and interlocking means are provided mounted on said front side of said head proximate to said mandrel to close and interlock successively adjacent turns of the formed strip. Means for storing a variable length of said formed strip between said closing and interlock means to provide a substantially constant reservoir or supply of formed strip at the closing station.

BRIEF DESCRIPTION OF THE DRAWING

The accompanying drawings show a present exemplary embodiment of the invention, in which.

DESCRIPTION OF THE PREFERRED EMBODIMENT

Figure 1:
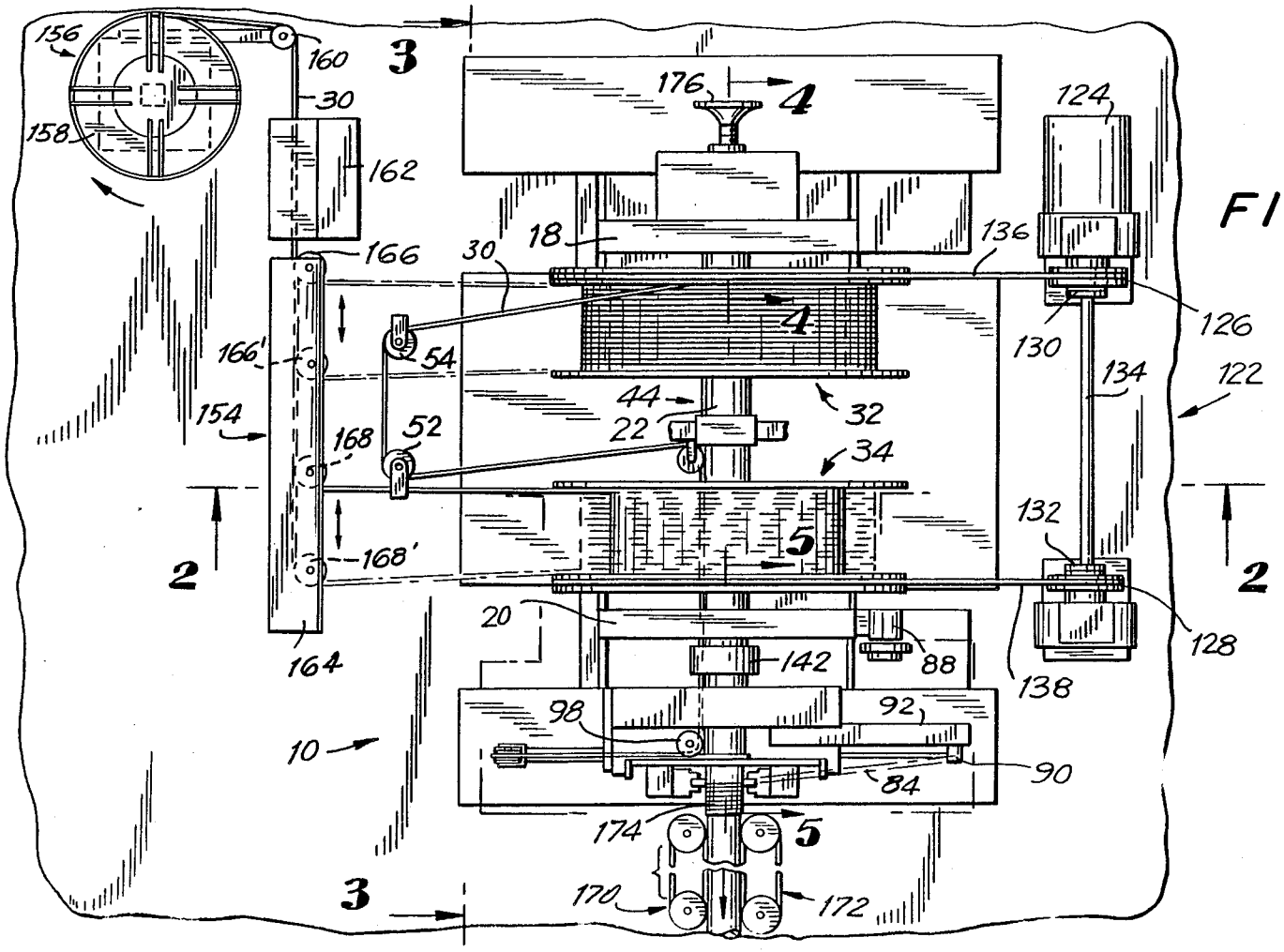
FIG. 1 is a top plan view of an apparatus for making helically wound interlocked flexible pipe in accordance with the present invention, showing the flexible pipe product being formed, in its initial stage, and showing the alternate positions of the traverse of the rewinding system for rewinding each of the two supply spools.
Figure 2:
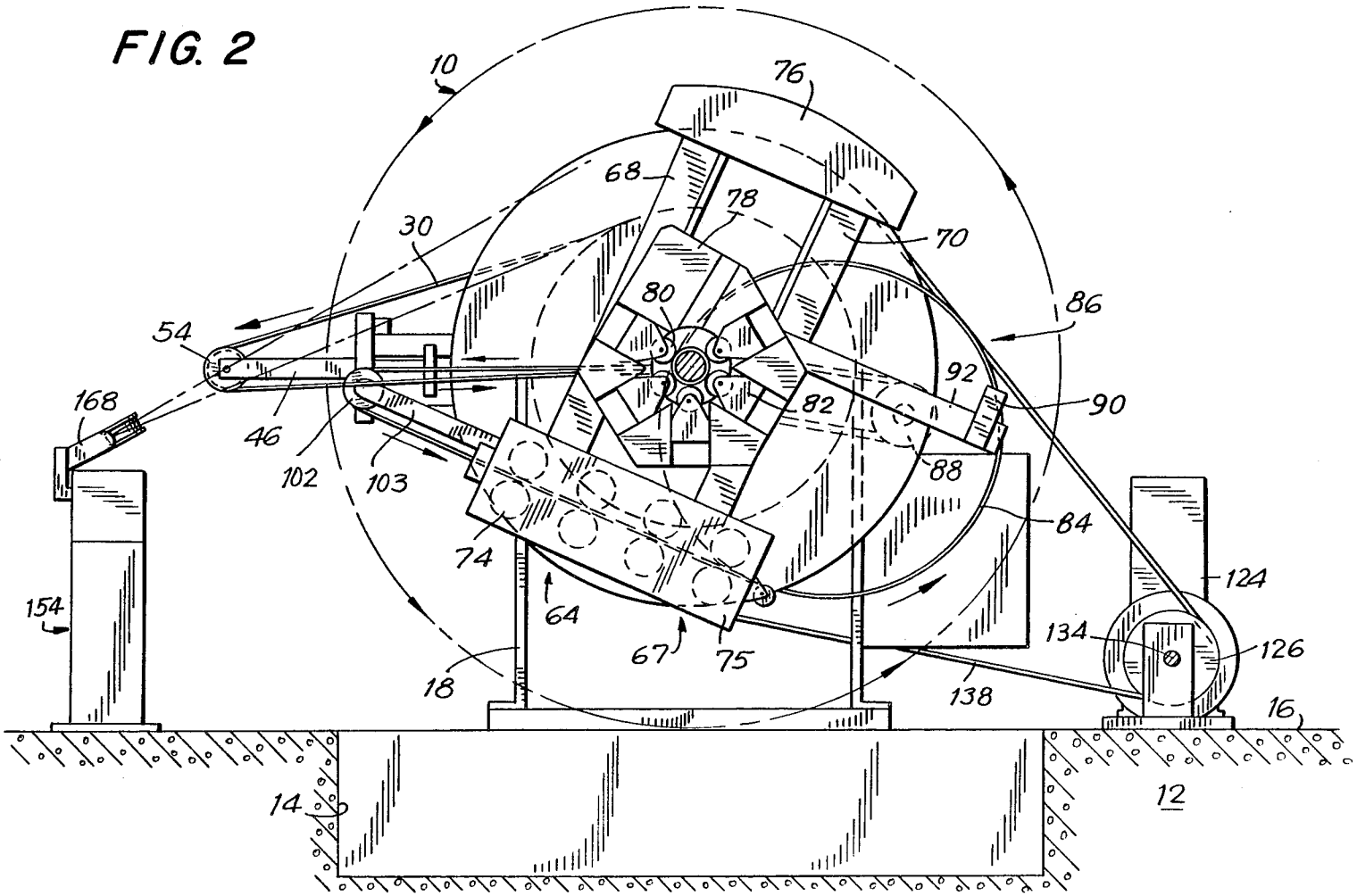
FIG. 2 is a cross-sectional view of the apparatus shown in FIG. 1, taken along line 2—2.
Figures 3, 6:
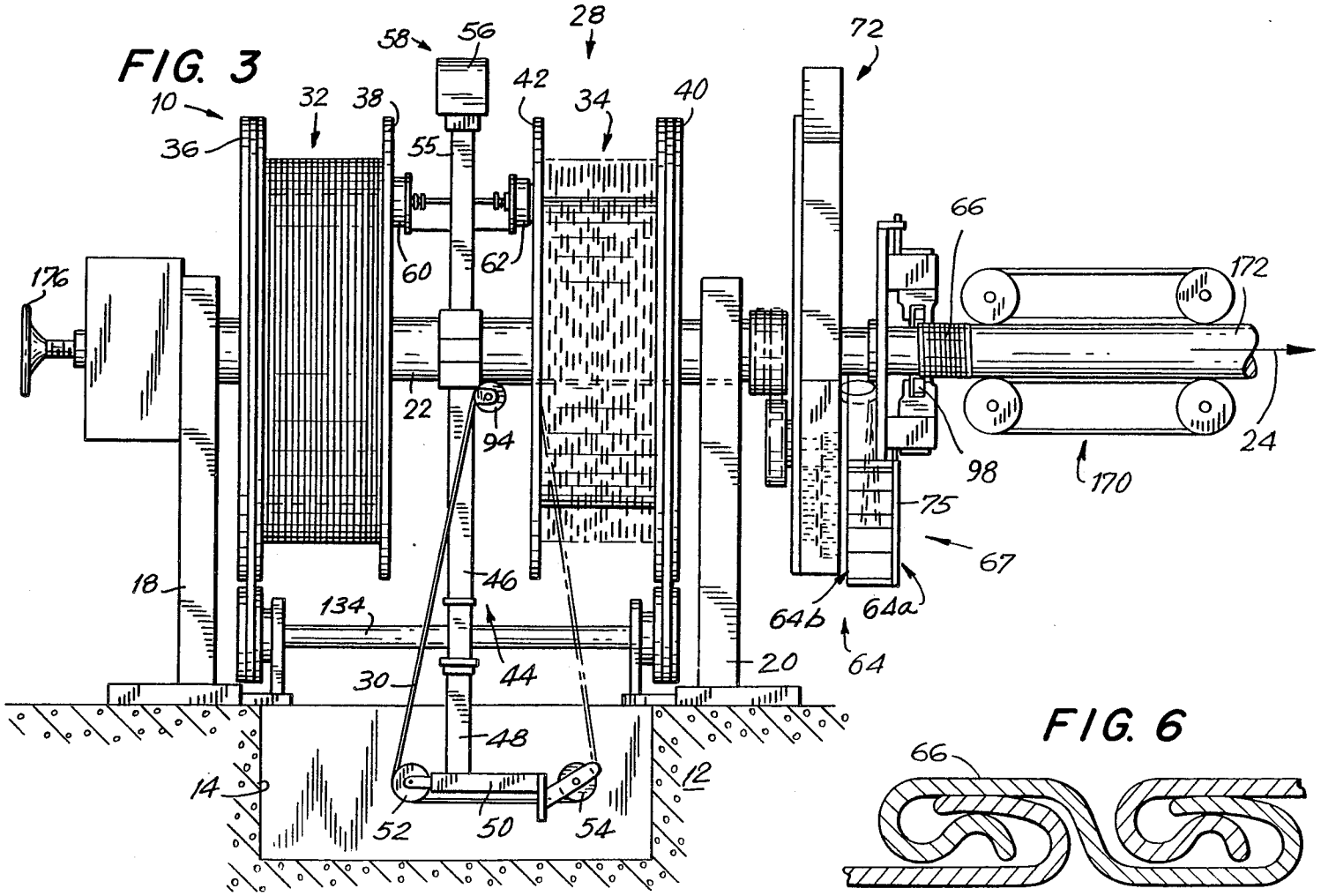
FIG. 3 is a side elevational view of the apparatus shown in FIG. 1, as viewed along line 3—3.
FIG. 6 illustrates a cross section of a typical helically wound interlocked flexible pipe made with the apparatus of FIGS. 1-5.

Referring now specifically to the drawings, in which identical or similar parts will be designated by the same reference numerals throughout, and first referring to FIGS. 1-3, the apparatus for making helically wound interlocked flexible pipe in accordance with the present invention is generally designated by the reference numeral 10. The apparatus 10 is supported on a concrete foundation 12 provided with a recess or opening 14 which extends below the surface 16 of the foundation as shown. The purpose of the recess 14 will be described below.

Referring specifically to FIG. 3, the apparatus 10 includes a pair of main bearing stands 18, 20, each of which is supported on an opposite side of the recess 14. Mounted on the main bearing stands 18, 20 is a shaft 22 which extends substantially the entire longitudinal length on of the machine, and is mounted on bearings, to be more fully described in connection with FIGS. 4 and 5, about a machine axis 24.

As will be more fully described in connection with FIGS. 4 and 5, a tubular mandrel 26 is arranged coaxially with the main shaft 22 for rotation about the axis 24.

Strip supply means is provided and generally designated by the reference numeral 28. The strip supply means supplies strip material 30, which is typically a flat formable metal strip. The function of the strip supply means is to supply strip material to a closing and interlocking station, as will be more fully described below.

Advantageously, the strip supply means 28 includes at least one spool of strip material. In the presently preferred embodiment, as shown in FIGS. 1 and 3, two strip supply reels 32, 34 are provided, sometimes referred to as "dummy spools" because they remain in place and are repeatedly refilled after they are depleted of the material wound thereon. As shown, the two spools 32, 34 are axially spaced from each other along the main shaft 22, and are each mounted for rotation about the machine axis 24. The spool 32 includes flanges 36 and 38, while the spool 34 includes flanges 40 and 42.

Mounted intermediate the two dummy spools 32, 34 is a take-off mechanism 44 fixedly mounted on the main shaft 22 for rotation therewith for removing and guiding the strip material 30 alternately from one of the spools 32, 34 and feeding the strip material to a forming station, to be described.

The take-off mechanism 44 comprises a guide beam assembly consisting of an elongate radial beam 46 fixedly mounted at an intermediate point thereof to the main shaft 22 for rotation as shown. A free end 48 of the beam 46 extends radially beyond the flanges 36, 38, 40, 42 of the spools 32, 34. A cross bar 50 is provided at the free end 48 which supports take-off pulleys 52, 54 for initially receiving the strip material 30 from a spool and directing same to further guide pulleys which will be more fully described. In FIG. 1, for example, the strip material 30 is shown being removed from the dummy spool 32, while in FIG. 3, the strip material 30 is shown being unwound from the dummy spool 34. However, in order to facilitate uniform take-off, the cross bar 50 is advantageously mounted for pivotal rotation about the axis of the beam 46, so that the initial take-off guide pulley 54 can be selectively positioned substantially centrally opposite each of the dummy spools from which the flat strip material is unwound.

The other end 55 of the beam 46 extends in the diametrically opposite direction of the beam 46 and is provided with a counterweight 56 so that the two opposing sections of the beam are balanced in relation to the main shaft 22.

Rotation is imparted to the guide beam assembly 44 through the main shaft 22. Engaging means 58 is provided which includes a first brake 60, adapted to selectively engage the flange 38, and a second brake 62 which is arranged to selectively engage the flange 42. The brakes 60, 62, when actuated, frictionally engage the associated flanges, to impart rotation of the associated spool to brake the spool and to allow relative movement between the assembly 44 and the associated spools in order to permit unwinding of the strip under proper tension.

As will be appreciated, in order to clear the flanges of the dummy spools 32, 34, the beam 46 must be sufficiently long to radially extend beyond the flanges and position the take-off or deflecting pulleys 52, 54 at a distance to provide suitable fleeting angles. The recess 14, above noted, is provided to permit the use of sufficiently long beams 46 which can rotate while clearing the foundation upon which the machine is supported.

Referring to FIG. 3, a rotating head 64 is provided which is mounted for rotation on the main shaft 22 about the machine axis 24 which, as noted, substantially coincides with the longitudinal axis of the interlocked flexible pipe 66 to be formed. The rotating head 64 defines a front side **64*a* facing the downstream direction where the product 66 is formed and an opposing rear side 64*b* facing the upstream direction where the supply spool 32, 34 are located. Referring to FIG. 2, the rotating head 64 is shown to include a tool head assembly 67, mounted for rotation about the machine axis 24. The tool head assembly includes spaced parallel support members 68, 70, at one end of which there is mounted gear box 72 for driving four pairs of forming or shaping rollers 74 to form a forming or rolling mill 75. At the opposite ends of the support members 68, 70, there is provided a counterweight 76 to insure that the rotating head 64** is balanced and can, therefore, rotate at relatively high speeds.

Also referring to FIG. 2, a face plate assembly is shown designated by the reference numeral 78 which is similarly mounted on the main shaft 22 for rotation therewith about the machine axis 24 and for supporting the closing and interlocking tools which are shown in FIG. 2 to be in the nature of free rolling pressure rollers 80 each respectively mounted on another associated roller mounting block 82. The pressure rollers 80 are mounted as suggested in FIG. 2, and are circumferentially spaced from each other about the axis of the machine. As best shown in FIG. 5, the tool head and face assemblies 67, 78 are axially off-set from each other to orient and arrange the formed strip material into a configuration which predisposes the strip to assume the shape of a helical convolution suitable for formation of the helically wound interlocked flexible pipe (FIG. 1).

An important feature of the present invention is the provision of means for storing a variable length of the formed strip 30 between the exit side of the driven forming mill 75 and the closing and interlocking pressure rollers 80. As shown in FIG. 2, the substantially constant supply or reservoir of the formed strip is configured as a loop 84 which forms a curved path between the forming mill 75 and the pressure rollers 80. As discussed in the Background of the Invention, because it is impossible to coordinate the instantaneous speed of production of the formed product by the forming mill 75 with the instantaneous rate or speed at which the formed strip is used at the closing station during manufacture of the finished product, the instantaneous size of the loop 84 will tend to vary from the nominal size shown in FIG. 2. Thus, as the supply increases in such "buffer" zone, the size of the loop will expand, while the depletion of such formed strip in the reservoir causes a contraction in the size of the, loop. One of the important features of the present invention, therefore, is the provision of a loop size control assembly 86 which is provided to maintain the loop 84 at a substantially predetermined or nominal size to thereby maintain a substantially constant supply or reservoir of formed strip between the driven forming mill 66 and the closing and interlocking pressure rollers 80. It should be evident to anyone skilled in the art that there are numerous different ways of monitoring the size of the loop 84 which can be used in a feedback scheme to regulate the driven speed of the forming rollers 74. As shown in FIG. 2, such control assembly 86 monitors the size of the loop, and a variable speed drive 88 is used for driving the forming mill 75 at a speed which is a function of the size of the loop 84. In this manner, variations in the size of the loop 84 are substantially eliminated and the loop 84 is restored and maintained at a nominal size by compensating changes in the speed of the variable rolling mill motor drive 88.

In the presently preferred embodiment, sensing is achieved by the used of a sensing dancer 90 supported on a support arm 92 mounted for rotation with the rotating head 64, so that contractions and expansions in the size of the loop 84 are continually monitored and detected by engagement with or abutment against the sensing dancer 90. Other sensing means can be used, such as for example, an optical scanner.

It will be evident that the flat strip 30 is initially imparted a predetermined intermediate cross-sectional configuration in the forming mill 75 suitable for interlocking in a closing step, as is well known to those skilled in the art. The pressure rollers 80 close and interlock successively adjacent turns of the formed strip to form the flexible pipe or product 66. A typical cross section of such a pipe is shown in FIG. 6

Because a number of members are mounted on and rotate with the main shaft 22 it is important to guide the flat strip material from the spools 32, 34 to a point beyond the tool head assembly 67, where it can be formed and further processed without being damaged by contact with the stationary members. For this purpose, suitable guide means are provided for guiding the strip material 30 from the spools to the front side **64*a* of the rotating head. Such guide means of the present invention includes a first guide pulley 94 mounted on the beam 46 proximate to the main shaft 22. The guide pulley 94 guides the strip material 30 from the take-off pulley 52 to a position substantially along the surface of the main shaft 22. Referring to FIG. 5, the main shaft 22 is shown to be provided with a surface slot or groove 96 for receiving and guiding the strip material between an entrance point, proximate to the pulley 94, and an exit point at the front side of 64*a* of the rotating head 64, proximate to a further guide pulley 98 which is mounted on the main shaft for rotation therewith. The pulleys 94, 98 deflect and guide the strip into and out of the surface slot or groove 96** at the entrance and exit points of the shaft, respectively, as shown.

Figure 5:
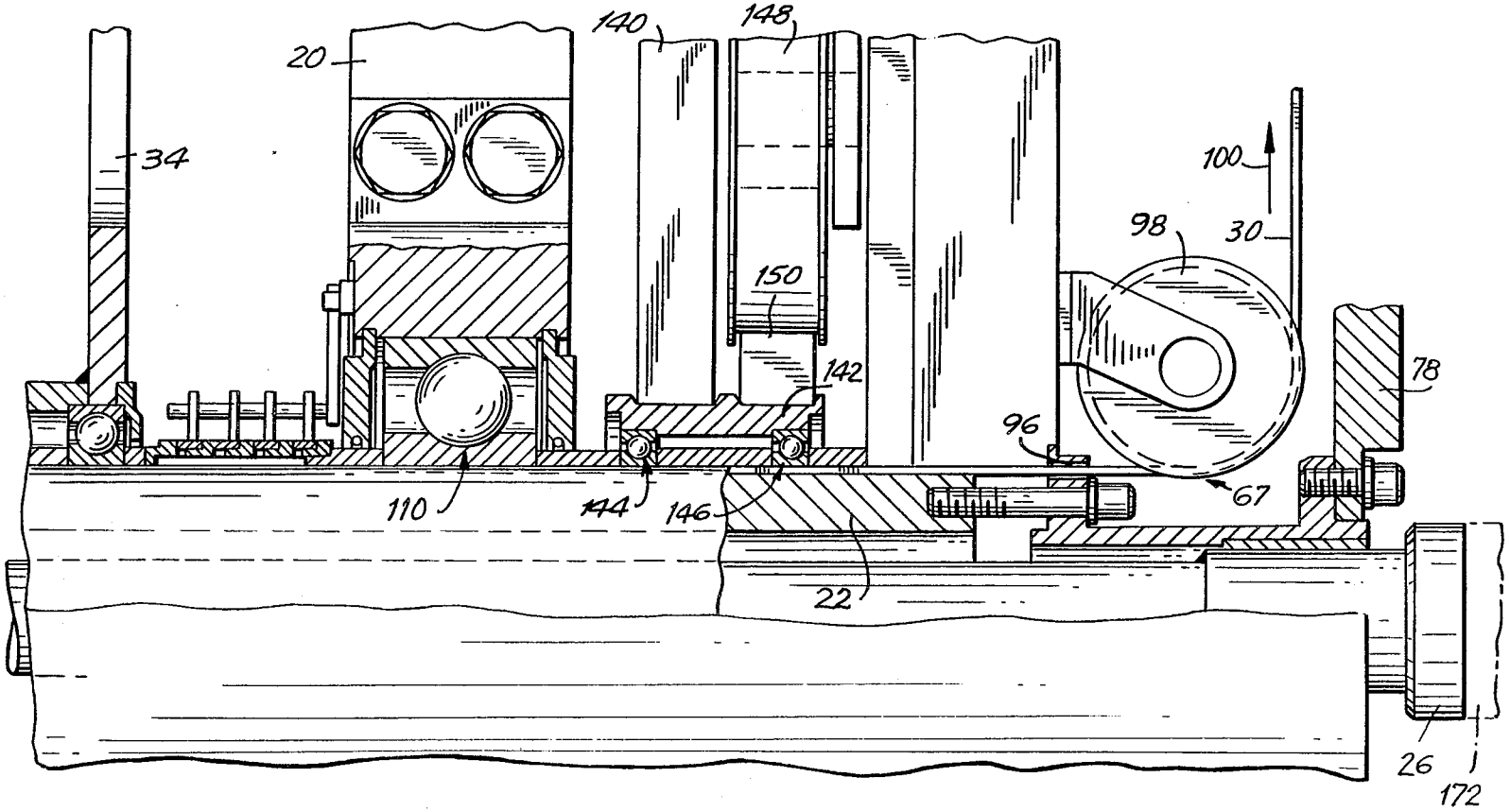
FIG. 5 is an enlarged cross-sectional view of the apparatus shown in FIG. 1, taken along line 5—5, showing some details of mounting of the tool head and face plate assemblies on the main shaft, a portion of the epicyclic train for driving the forming mill rollers on the tool head assembly, and the electrical brush assembly for transmitting an electrical output of a loop control sensor to the rolling mill drive.

After being deflected by the guide pulley 98, the strip material 30 is directed radially outwardly in the direction of the arrow 100 in FIG. 5. The purpose of the guide pulleys, therefore, is to feed the flat strip material from the dummy spools 32, 34 to a point along the main shaft 22, and then along the shaft, to avoid contact with the stationary parts, to a point where it may be fed to the forming mill 75.

As best shown in FIG. 2, the radially outward movement of the strip 30, beyond the guide pulley 98, directs the strip material towards a deflecting pulley 102 which is mounted on a support arm 103 on the rotating head 64 remotely from the axis 24 for receiving the radially outwardly moving strip material and redirecting the strip material 30 radially inwardly to the forming mill 75, as indicated by the arrow, to allow a twist of the strip material about its longitudinal axis. As should be evident, the strip material is initially guided by the pulley wheel 98 which is mounted for rotation about an axis substantially normal to the machine axis 24. However, the axis of the pulley 102 is substantially parallel to the machine axis, and, therefore, a 90° twist in the flat strip material is required. By spacing the pulley wheel 102 at a sufficient distance from the axis of the machine, such a twist may be effected without damage to the strip material.

Numerous drives may be used for rotation of the various rotating members, as should be evident to those skilled in the art. Specific examples of such drives will be described in connection with the preferred embodiment, although it will be appreciated that none of these are critical and other suitable drives may be used. Referring to FIG. 4, the main shaft 22, at the input or upstream end of the machine, is connected to a pulley 104 which is driven by a belt 106 suitably coupled to a drive motor (not shown). The main shaft 22 is rotatably supported on a main bearings 108, 110 supported on main bearing stands 18, 20.

A pinion gear 112 is rotatably journaled on bearings 114, 116. A sprocket wheel 118 is fixedly connected to the pinion gear 112 for rotation therewith. The sprocket wheel 118 is suitably coupled by means of a chain (not shown) to another sprocket wheel itself coupled to the main drive motor, so that the pinion gear 112 is caused to rotate with the rotation of the main shaft 22. A drive gear 120 is mounted on the mandrel shaft 26 and engaged with the pinion gear 112. It will be appreciated, therefore, that the mandrel shaft 26 is caused to rotate in a direction which is opposite to the direction of rotation of the main shaft 22. The relative speed of rotation will, of course, be a function of the dimensions and characteristics of the drive train components. For reasons which will become evident to those skilled in the art, the apparatus in accordance with the present invention can be used in any one o a number of different modes. Thus, for example, the mandrel shaft 26 can be mounted for free rotation, it can be fixed against rotation, and, as shown it can be imparted rotation. In the presently preferred embodiment, such imparted rotation is at a relatively slow speed and in the opposite direction to the main shaft and rotating head. Such slow opposite rotation has a tendency to and facilitates release of the helically wound flexible pipe or carcass from the mandrel shaft, an approach which has be practiced since at least as early as 1876 as exemplified by U.S. Pat. No. 183328 to Root. The specific mode of operation of the mandrel shaft will, however, be a function of the size and the material of the finished product, the lubricants used, etc. In this connection, it is also advantageous that the free end of the mandrel upon which the pressure rollers 80 interlock and close the successfully adjacent helical turns is slightly or gently tapered to facilitate removal of the product from the mandrel during the production of the product. Referring to FIG. 1 the drive for rewinding of the dummy spools 32, 34 is shown, which includes a motor 124. Each spool 32, has associated therewith a pulley 126, 128 and a clutch 130, 132 respectively, for selectively coupling an associated pulley to the drive shaft of the motor 124. In order to couple the motor 124 to the remote pulley 128, any suitable connecting shaft may be used such as a universal joint 134. Advantageously, suitable brakes are provided to stop the rotation of the pulleys 126, 128 and, therefore, the associated spools 32, 34, which are coupled to the pulleys by means of belts 136, 138 as shown. Such arrangement allows the use of a single motor 124 to selectively drive one of each of the two spools at any given time while the other spool is allowed to freely rotate.

Referring to FIGS. 2 and 5, the roller forming mill 75 is driven at a speed or rate which can be substantially instaneously adjusted. The forming rollers 74 on the mill 75 are coupled in any suitable manner, such as the gear box 72, to rotate simultaneously and cooperate in a well known manner, to form the strip 30. For this purpose the motor 88 is shown coupled by means of drive belt 140 to a pulley 142 mounted on the main shaft 22 by means of ball bearings 144, 146. The rotation of the pulley 142 which is imparted by the belt 140 is transmitted to a pulley 148 by means of a drive belt 150 which engages the pulley 142. The pulley 148 is mounted on the tool head assembly 67 and is coupled to the gear box 72 which drives the individual forming rollers 74 mounted on the tool head assembly 67 in a known manner. It will, therefore, be appreciated that the variable speed obtainable by means of the adjustable speed motor 88 can be transmitted to the forming rollers 74 by means of the aforementioned belts and pulleys arrangement, shown in FIG. 5, which forms an epicyclic drive train which enables the power from the motor 88 to be transmitted to the forming rollers 74 independently of the specific angular position that the tool head assembly 67 assumes about the machine axis 24. As with the other drives, however, it should be evident that alternative arrangements may be used, with differing the degrees of advantage, as well know to those skilled in the art.

Referring to FIGS. 1 and 2, the machine is advantageously provided with a rewinding system generally designated by the reference numberal 154. The function of the rewinding system is to rewind or replenish strip material to that spool 32, 34 which has become depleted. It will be evident that by using two separate spools as shown, it is possible to take off from one of the spools while the other spool, which may be empty, is rewound. The relative speeds of strip depletion form one spool and rewinding of such strip material onto the other spool are selected so that the rewinding process takes less time than it takes to deplete a spool. In this way, a full spool is always available and ready to take over when the feeding spool becomes empty.

In FIG. 1, the rewinding system 154 is shown to include a flat pancake pay-off assembly 156 which includes a flat pancake 158 of strip material of the type commonly known to those skilled in the art. The flat strip is usually purchased in a flat pancake containing at maximum about 800 lbs. of material. This quantity is sufficient for a reasonable production run for small pipe, but would provide only around 40 ft. for a 10" pipe. A dancer mechanism 160 is provided for unwinding the strip material from each individual strip pancake 158 under controlled tension.

In order to avoid stopping the machine every few minutes, the present invention allows an operator to weld together several pancakes and rewind the strip into one of the dummy spools which can contain 10 to 12 times the material of the individual packages. Once this is done, the dummy spool can be connected to the forming head and product can be made. While this occurs, the operator will rewind and weld the strip on the second dummy spool. Thus, the strip material from each individual strip pancake is advanced through a welding station 162, the function of which is to weld the end of a strip pancake with the beginning of a next successive strip pancake so as to provide a continuous length of strip material for winding onto the dummy spools 32, 34. The rewinding system 154 also includes a traverse assembly 164 which includes guide pulleys 166 and 168 which are spaced from each other and mounted for reciprocating movement, as suggested by the arrows. The pulley 166 is movable between the position shown and a position designated by the reference numeral 166' while the pulley 168 similarly moves between the position shown and a position designated by the reference numeral 168'. Depending on which dummy spool 32, 34 is being wound the strip material 30 is deflected by the appropriate pulley which reciprocates between the end positions or limits shown so as to substantially traverse the width of the associated spools to thereby assure substantially even or equal distribution of the flat strip over the axial dimension of the spool. In FIG. 1, the flat strip material 30 is shown being unwound from the dummy spool 32, while the flat strip material is wound onto the dummy spool 34 by means of the deflecting pulley 168. Of course, when the dummy spool 34 is being unwound the pulley wheel 166 is used to rewind the dummy spool 32. In each case, therefore, each of the deflecting pulley wheels 166, 168 reciprocates in a direction substantially parallel to the machine axis.

Referring to FIGS. 1 and 3, there is shown a caterpuller 170 downstream from the machine and arranged in line with the machine axis 24. The caterpuller 170 is spaced at an appropriate distance from the mandrel shaft 26 so that it may engage the helically would flexible pipe as it is cast off from the mandrel shaft 26. The caterpuller 170 serves both to pull the finished product in the direction suggested by the arrows, as well as angularly fix the position of the finished product so it does not rotate due to the action of the pressure rollers 80 or due to the rotation of the mandrel shaft itself. The construction and operation of caterpullers are well known to those skilled in the art.

Figure 4:
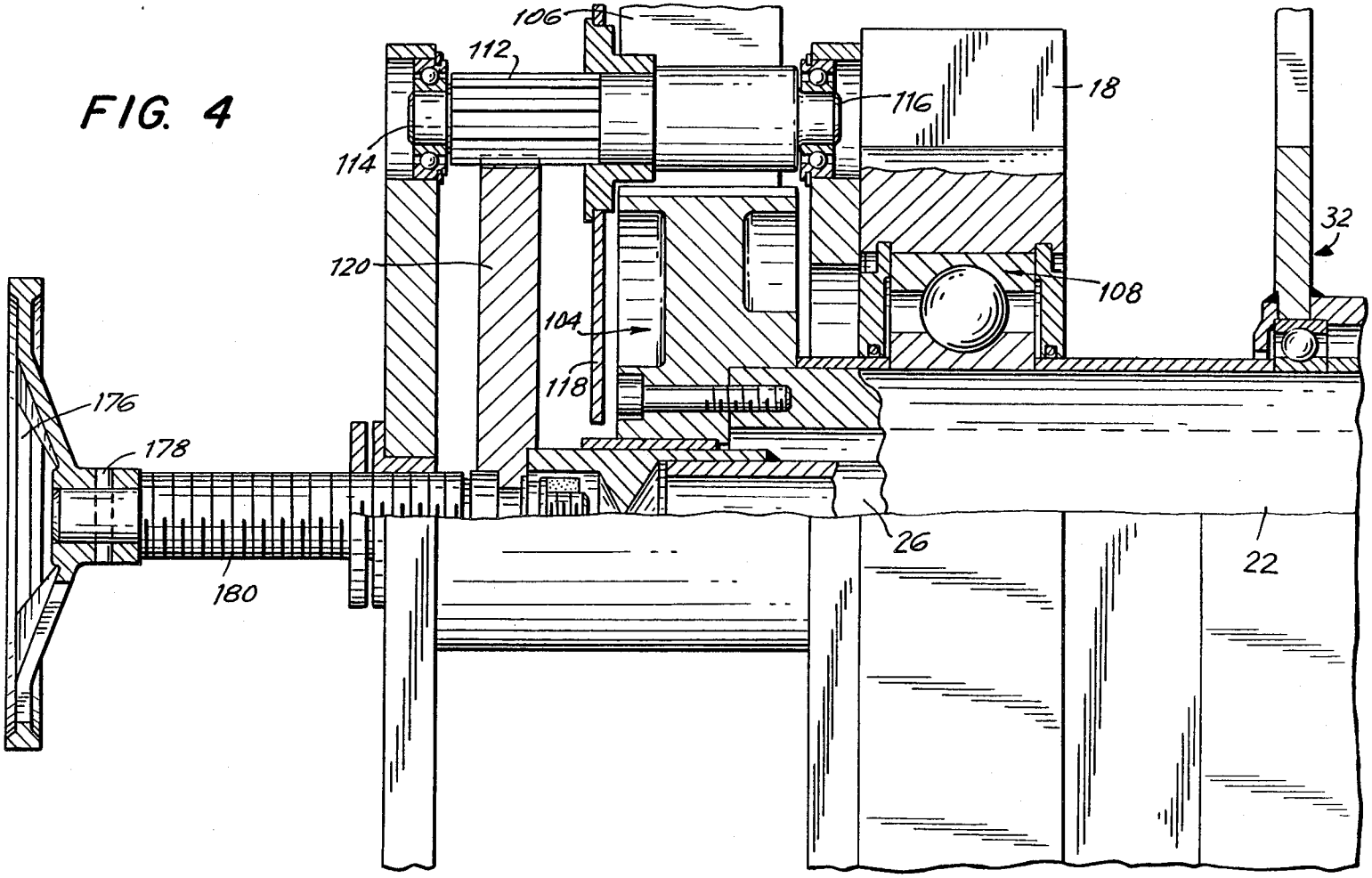
FIG. 4 is an enlarged cross-sectional view of the apparatus shown in FIG. 1, taken along line 4—4, showing some details of the drive for the main shaft and the direction reversing drive for the mandrel shaft.

In accordance with one feature of the invention, in order to provide a fast and efficient means to start the production of the flexible pipe, position adjusting means is provided, shown in FIGS. 1, 3 and 4, for axially moving the mandrel shaft upstream along the machine axis. Such retraction permits positioning of a pilot mandrel extension 172 such that its upstream end is arranged in the plane of the closing pressure rollers 80. The mandrel extension 172 is not fixed or permanently attached to the mandrel shaft 26, but is detachably coupled to the mandrel to ensure concentric alignment with the machine axis. With the mandrel shaft 26 retracted, the mandrel extension assumes a position having one end thereof in the plane of the pressure rollers 80 and the other end thereof extending through and gripped by the caterpuller 170. In this capacity, the mandrel extension 172 serves as a pseudo or temporary fixed mandrel upon which the pressure rollers 80 close and interlock the initial turn of the strip to start the production of the flexible pipe. The mandrel extension 172 prevents the rotation of the finished product about the machine axis 24 and secures such product against rotation. For this purpose, the mandrel extension 172 is advantageously provided with a slot or other suitable means for gripping the free end of the strip material to insure the formation of the initial turns or convolutions of the flat strip material. Any other suitable gripping means may, however, also be used.

The position adjusting means for the mandrel is shown in FIGS. 1, 3 and 4 and includes a hand wheel 176 mounted coaxially with machines axis 24 which is coupled by means of pin 178 to a feed screw 180 which coaxially mounted and engaged with the mandrel shaft 26. During initial production of a flexible pipe, and operator rotates the hand wheel 176 so as to retract the mandrel shaft as above suggested. Once the mandrel extension 172 is in place and production of flexible pipe has commenced, the operator advantageously slowly turns the hand wheel 176 to gradually move the mandrel shaft 26 downstream to compensate for the advancing movement of the mandrel extension 172 and the resulting product. The handwheel continues to be rotated until the mandrel 26 has been returned to its fully extended normal operating position. Although a manual approach has been described to adjust the position of the mandrel, it should be evident that an automated system can be used for causing such adjustments or movements of the mandrel shaft automatically. After a sufficient quantity of flexible pipe 174 has been created and the length of resulting pipe is sufficient to extend through and be gripped by the caterpuller 170, the flexible pipe is prevented from rotation while it advances downstream. At such time, the mandrel extension 172 has ceased to perform its intended function and may be removed and separated from the finished product and may be reused to start the production of a new pipe.

As should be evident from the foregoing description, the apparatus in accordance with the present invention optimizes the rapid and efficient manufacture of helically wound interlocked flexible pipe, with minimum damage to the finished product and downtime of the machines. By providing a controlled loop of formed strip material, the apparatus almost completely eliminates the likelihood of buckling. Also, the use of two dummy spools as described prevents unnecessary downtime. Furthermore, by providing a storage loop of the type, shown and described and by axially spacing the tool head assembly from the face plate assembly, where forming and closing, respectively, take place the formed strip material is imparted bends or deformations with the desired bending of the strip in the formation of the finished product. Not only is the performed strip material arranged in a curved path which promotes winding about a cylindrical mandrel shaft, but the successive adjacent turns are arranged, through bending, to assume the shape of a helical convolution suitable for formation of the helically wound finished product.

While the supply spools of the strip material have been described as being located behind or upstream of the rotating head 64 and guided upstream thereof for forming and further processing, many of the advantages of the apparatus can still be obtained by positioning the strip supply downstream of the rotating head, such as on the rotating tool assembly 67. However, with such an arrangement, the rotating head 64 must be stopped to reload. Additionally, the constantly changing weight of a depletable supply makes it almost impossible to balance the rotating head except possibly at one level of depletion, and this prevents operation of the machine at maximum rotating speeds.

While an exemplary embodiment of the invention has been as shown and described, it will be recognized that this invention may be modified and otherwise variously embodied and practiced within the scope of the following claims.

What is claimed is:

1. Apparatus for making helically wound interlock flexible pipe comprising:

a rotating head mounted for rotation about an axis which substantially coincides with the longitudinal axis of the interlocked flexible pipe to be formed, said rotating head defining a front side facing the direction where the product is formed and an opposing rear side;

strip supply means for supplying strip material to said front side of said rotating head;

driven forming means for forming said strip material into a formed strip having a predetermined intermediate cross-sectional configuration suitable for interlocking in a closing step;

a tubular mandrel coaxial with said axis projecting beyond said front side of said rotating head;

closing and interlocking means mounted on said front side of said head proximate said mandrel to close and interlock successively adjacent turns of the formed strip; and means for storing a variable length of said formed strip between said driven forming means and said closing and interlocking means.

2. Apparatus according to claim 1, wherein said variable length of stored formed strip is configured as a loop in a curved path; and further comprising a loop size control assembly for maintaining said loop at a substantially predetermined size to thereby maintain a substantially constant supply or reservoir of formed strip between said driven forming means and said closing and interlocking means.

3. Apparatus according to claim 2, wherein said loop size control assembly comprises a sensing means for monitoring the size of said loop; and variable speed drive means for driving said driven forming means at a speed which is a function of the size of said loop, whereby variations in the size of the loop are substantially eliminated and the loop is restored and maintained at a nominal size by compensating changes in the speed of said variable speed means.

4. Apparatus according to claim 3, wherein said variable speed drive means comprises forming rollers mounted on said rotating head and an epicyclic drive train for coupling said forming rollers to a stationary variable speed motor.

5. Apparatus according to claim 3, wherein said sensing means comprises a sensing dancer mounted for rotation with said rotating head wherein contractions and expansions in the size of said loop are detected by engagement with or abutment against said sensing dancer.

6. Apparatus according to claim 1, wherein said strip supply means includes at least one spool of strip material on said rear side of said rotating head; and guide means for guiding said strip material from said rear to said front side of said rotating head.

7. Apparatus according to claim 6, wherein said guide means comprises guide pulleys for guiding the strip material from said at least one spool to a position substantially coaxial with the axis of said rotating head, and subsequently along said coaxial position to a point on the front side of said rotating head.

8. Apparatus according to claim 7, further comprising a main shaft for supporting and rotatably mounting said rotating head, said guide means further comprising a longitudinal surface slot or groove in said main shaft for receiving and guiding the strip material between entrance and exits points of said shaft respectively.

9. Apparatus according to claim 7, further comprising a deflecting pulley remotely mounted on said rotating head from said axis for receiving radially outwardly moving strip material from a spool on said front side of said rotating head and redirecting said strip material radially inwardly to said drives forming means said deflecting pulley being radially spaced from said axis to a sufficient distance to allow a twist of said strip material about it longitudinal axis.

10. Apparatus of claim 1, wherein said closing and interlocking means comprises a plurality of free rolling pressure rollers mounted on said rotating head and circumferentially spaced from each other about said axis.

11. Apparatus of claim 1, wherein said rotating head comprises a tool head assembly mounted for rotation about said axis for supporting said driver forming means, and a face plate assembly mounted for rotation about said axis for supporting said closing and interlocking means, said tool head and face plate assemblies being axially offset from each other, to impart a bend to the formed strip material which predisposes the strip to creation of helical convolutions suitable for formation of the helically wound interlocked flexible pipe.

12. Apparatus of claim 6, wherein said strip supply means comprises two spools on said rear side of said rotating head, said two spools being spaced from each other along said axis and each mounted for rotation about said axis.

13. Apparatus of claim 12, further comprising take-off means mounted for rotation about said axis for guiding strip material alternatively from one of said spools and feeding said strip material to said guide means.

14. Apparatus according to claim 13, wherein said take-off means comprises an elongate radial beam rotatably mounted about said axis and having a free-end thereof extending in one radial direction and extending beyond the rims of said spools, and take-off pulleys mounted at said free end for receiving said strip material from a spool and directing same to said guide means.

15. Apparatus according to claim 14, further comprising a counterweight at another end of said radial beam which extends in the opposite radial direction.

16. Apparatus according to claim 13, wherein said take-off means is arranged between said two spaced spools, and further comprising engaging means for selectively engaging one of said spools with said take-off means.

17. Apparatus according to claim 16, wherein said engaging means comprises a brake for providing frictional engagement between a spool and said radial beam.

18. Apparatus according to claim 6, further comprising a system for rewinding strip material onto said spool.

19. Apparatus according to claim 18, wherein said rewinding system includes a traverse for reciprocating in the direction parallel to said axis and for uniformly distributing flat strip material on said spool.

20. Apparatus according to claim 19, further comprising welding means for welding the ends of elongate strip material prior to winding on said spool, whereby long lengths of strip material can be stored on said spool.

21. Apparatus according to claim 1, further comprising a caterpuller axially downstream of said tubular mandrel; position adjusting means for axially moving said mandrel between normal and retracted positions; and an extension pilot mandrel adapted to be mounted coaxially between said retracted position of said tubular mandrel and said caterpuller for serving as a temporary mandrel until sufficient product has been formed and received within said caterpuller to prevent rotation of the product during formation, whereby said tubular mandrel is gradually advanced as product is formed until said tubular mandrel has been returned to its normal position.

22. Apparatus according to claim 1, further comprising mandrel drive means for rotating said tubular mandrel about said axis in relation to said rotating head.

23. Apparatus according to claim 22, wherein said mandrel drive means includes means for driving said tubular mandrel in a direction opposite to the direction of rotation of said rotating head.

24. Apparatus for making helically wound interlock flexible pipe comprising:

a rotating head mounted for rotation about an axis which substantially coincides with the longitudinal axis of the interlocked flexible pipe to be formed, said rotating head defining a front side facing the direction where the product is formed and an opposing rear side strip supply means for supplying strip material to said front side of said rotating head;

driven forming means for forming said strip material into a formed strip having a predetermined intermediate cross-sectional configuration suitable for interlocking in a closing step;

a tubular mandrel coaxial with said axis projecting beyond said front side of said rotating head;

closing and interlocking means mounted on said front side of said head proximate said mandrel to close and interlock successively adjacent turns of the formed strip;

a caterpuller axially downstream of said tubular mandrel;

position adjusting means for axially moving said mandrel between normal and retracted positions; and an extension pilot mandrel adapted to be mounted coaxially between said retracted position of said tubular mandrel and said caterpuller for serving as a temporary mandrel until sufficient product has been formed and received within said caterpuller to prevent rotation of the product during formation, whereby said tubular mandrel is gradually advanced as product is formed until said tubular mandrel has been returned to its normal position.

* * * * *